US008167644B2

(12) United States Patent
Mason et al.

(10) Patent No.: US 8,167,644 B2
(45) Date of Patent: May 1, 2012

(54) ELECTRICAL CONNECTOR FOR AN ELECTRONIC MODULE

(75) Inventors: Jeffery W. Mason, North Attleboro, MA (US); Scott Spicer, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 52 days.

(21) Appl. No.: 12/827,602

(22) Filed: Jun. 30, 2010

(65) Prior Publication Data

US 2012/0003879 A1 Jan. 5, 2012

(51) Int. Cl.
*H01B 5/14* (2006.01)

(52) U.S. Cl. ..... 439/516; 29/847

(58) Field of Classification Search ..... 439/516, 439/49, 43; 29/847, 843
See application file for complete search history.

(56) References Cited

U.S. PATENT DOCUMENTS 4,471,158 A * 9/1984 Roberts ..... 174/541
4,592,606 A * 6/1986 Mudra ..... 439/516
4,689,023 A * 8/1987 Strong et al. ..... 439/189
5,112,230 A * 5/1992 DeSimone ..... 439/55
5,772,451 A 6/1998 Dozier, II et al.
5,917,707 A 6/1999 Khandros et al.
6,086,413 A * 7/2000 Karasik et al. ..... 439/516
7,032,290 B2 * 4/2006 Hirano et al. ..... 29/596
7,114,961 B2 10/2006 Williams
7,229,295 B2 * 6/2007 Ice et al. ..... 439/79
7,371,073 B2 5/2008 Williams
7,871,298 B2 * 1/2011 Guo et al. ..... 439/630
2001/0006859 A1 * 7/2001 Soga et al. ..... 439/516

* cited by examiner

*Primary Examiner* — Gary F. Paumen

(57) ABSTRACT

An electrical connector is provided for electrically connecting an electronic module to an electrical component. The electrical connector includes electrical contacts having mounting bases that are initially mechanically connected together by a connection strip. The connection strip extends along a connection path from the mounting base of one of the electrical contacts to the mounting base of the other electrical contact. The connection strip is broken along the connection path such that the electrical contacts are separated from each other. The electrical connector also includes a insulator having a module side and an opposite component side. The mounting bases of the electrical contacts are mechanically connected to the insulator on the module side of the insulator. The insulator includes a punch opening that extends into the module side of the insulator. The punch opening is aligned with the connection path of the connection strip and is configured to receive a punch tool for breaking the connection strip.

24 Claims, 6 Drawing Sheets

ELECTRICAL CONNECTOR FOR AN ELECTRONIC MODULE

BACKGROUND OF THE INVENTION

The subject matter described and/or illustrated herein relates generally to electrical connectors, and more specifically, to electrical connectors for electronic modules.

Competition and market demands have continued the trend toward smaller and higher performance (e.g., faster) electrical systems. The resulting higher density electrical systems have led to the development of surface mount technology. Surface mount technology allows an electronic module to be electrically connected to contact pads on the surface of an electrical component, such as a printed circuit (sometimes referred to as a "circuit board" or a "printed circuit board"). The electronic module is connected to the electrical component either directly or through an intervening electrical connector, rather than using conductive vias that extend within the electrical component. Surface mount technology allows for an increased component density on the electrical component, which enables the development of smaller and higher performance systems.

Examples of electrical connectors for such smaller and higher performance electrical systems include land-grid array (LGA) sockets and ball-grid array (BGA) sockets. LGA sockets include an array of electrical contacts that are electrically connected to the electrical component and engage an array of contact pads on the electronic module. BGA sockets also include an array of electrical contacts that are electrically connected to the electrical component, but instead of contact pads the electrical contacts of BGA sockets engage an array of solder balls on the electronic module. The electrical contacts of both LGA sockets and BGA sockets may engage contact pads on the electrical component or may be electrically connected to the electrical component via an array of solder balls.

The electrical contacts of electrical connectors used to electrically connect an electronic module to an electrical component are typically fabricated from the same sheet or reel of material, for example by stamping or cutting the contacts out of the sheet or reel. Adjacent electrical contacts are connected together by a strip of material that remains after the contacts have been fabricated from the sheet or reel. For example, a row of the electrical contacts may be fabricated from the same sheet or reel, with each adjacent pair of contacts within the row being connected together by the strip. However, the trend toward higher density electrical systems results in a relatively small pitch between the electrical contacts. It may be difficult to separate adjacent electrical contacts from each other because of the relatively small pitch between the contacts. Specifically, because of the limited space between adjacent electrical contacts, it is difficult to break the strip that holds adjacent electrical contacts together. Traditionally, the strip connecting adjacent electrical contacts is broken before the contacts are mounted on an insulator of the electrical connector. Each electrical contact is then individually aligned and mounted on the insulator, which may increase the difficulty, expense, and/or time it takes to assemble the electrical connector.

BRIEF DESCRIPTION OF THE INVENTION

In one embodiment, an electrical connector is provided for electrically connecting an electronic module to an electrical component. The electrical connector includes electrical contacts having mounting bases that are initially mechanically connected together by a connection strip. The connection strip extends along a connection path from the mounting base of one of the electrical contacts to the mounting base of the other electrical contact. The connection strip is broken along the connection path such that the electrical contacts are separated from each other. The electrical connector also includes a insulator having a module side and an opposite component side. The mounting bases of the electrical contacts are mechanically connected to the insulator on the module side of the insulator. The insulator includes a punch opening that extends into the module side of the insulator. The punch opening is aligned with the connection path of the connection strip and is configured to receive a punch tool for breaking the connection strip.

In another embodiment, an electrical connector for electrically connecting an electronic module to an electrical component includes electrical contacts having mounting bases that are mechanically connected together by a connection strip. The connection strip extends along a connection path from the mounting base of one of the electrical contacts to the mounting base of the other electrical contact. The electrical connector also includes a insulator having a module side and an opposite component side. The mounting bases of the electrical contacts are mechanically connected to the insulator on the module side of the insulator. The insulator includes a punch opening extending into the module side of the insulator. The punch opening is configured to receive a punch tool. The punch opening is aligned with the connection strip such that when the punch tool is received within the punch opening the punch tool is positioned to break the connection strip.

In another embodiment, a method is provided for fabricating an electrical connector. The method includes providing electrical contacts having mounting bases that are mechanically connected together via a connection strip, soldering the mounting bases of the electrical contacts to corresponding solder pads of a insulator, and separating the electrical contacts from each other by breaking the connection strip after soldering the mounting bases of the electrical contacts to the solder pads of the insulator.

DETAILED DESCRIPTION OF THE INVENTION

Figure 1:
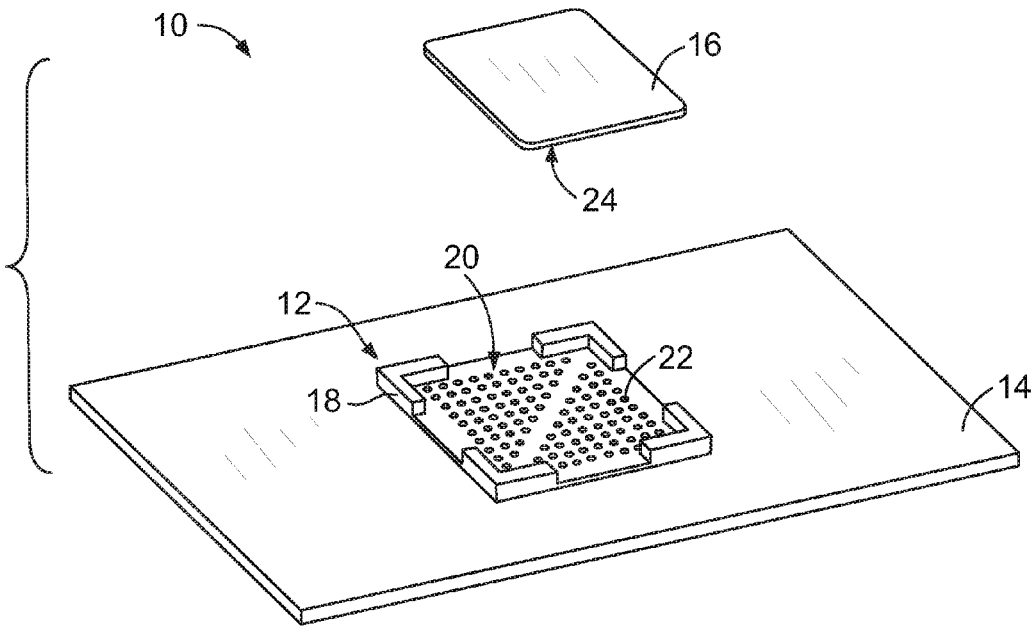
FIG. 1 is a partially exploded perspective view of an exemplary embodiment of an electrical system.

FIG. 1 is a partially exploded perspective view of an exemplary embodiment of an electronic assembly 10. The electronic assembly 10 includes an electrical connector 12, a printed circuit 14, and an electronic module 16. The electrical connector 12 is mounted on the printed circuit 14. The electronic module 16 is loaded onto the electrical connector 12 to electrically connect the electronic module 16 to the printed circuit 14 via the electrical connector 12. Optionally, the electrical connector 12 is a socket connector. The electronic module 16 may be any type of electronic module, such as, but not limited to, a chip, a package, a central processing unit (CPU), a processor, a memory, a microprocessor, an integrated circuit, a printed circuit, an application specific integrated circuit (ASIC), and/or the like.

The electrical connector 12 includes a dielectric alignment frame 18 that is mounted on the printed circuit 14. The alignment frame 18 holds an interconnect member 20 that includes an array of electrical contacts 22. The electronic module 16 has a mating side 24 along which the electronic module 16 mates with the interconnect member 20. The interconnect member 20 is interposed between contact pads (not shown) on the mating side 24 of the electronic module 16 and corresponding contact pads (not shown) on the printed circuit 14 to electrically connect the electronic module 16 to the printed circuit 14.

In the exemplary embodiment, the electrical connector 12 is a land grid array (LGA) connector. However, it is to be understood that the subject matter described and/or illustrated herein is also applicable to other connectors, connector assemblies, and/or the like, such as, but not limited to, ball grid array (BGA) connectors and/or the like. Moreover, while the electrical connector 12 is described and illustrated herein as interconnecting the electronic module 16 with a printed circuit 14, it should be understood that other electrical components may be interconnected with the electronic module 16 via the electrical connector 12, such as, but not limited to, a chip, a package, a central processing unit (CPU), a processor, a memory, a microprocessor, an integrated circuit, an application specific integrated circuit (ASIC), and/or the like. Furthermore, the electrical connector 12 is not limited to the number or type of parts shown in FIG. 1, but rather may include and/or operate in conjunction with additional parts, components, and/or the like that are not shown or described herein. Thus, the following description and the drawings are provided for purposes of illustration, rather than limitation, and is but one potential application of the subject matter described and/or illustrated herein.

Figure 2:
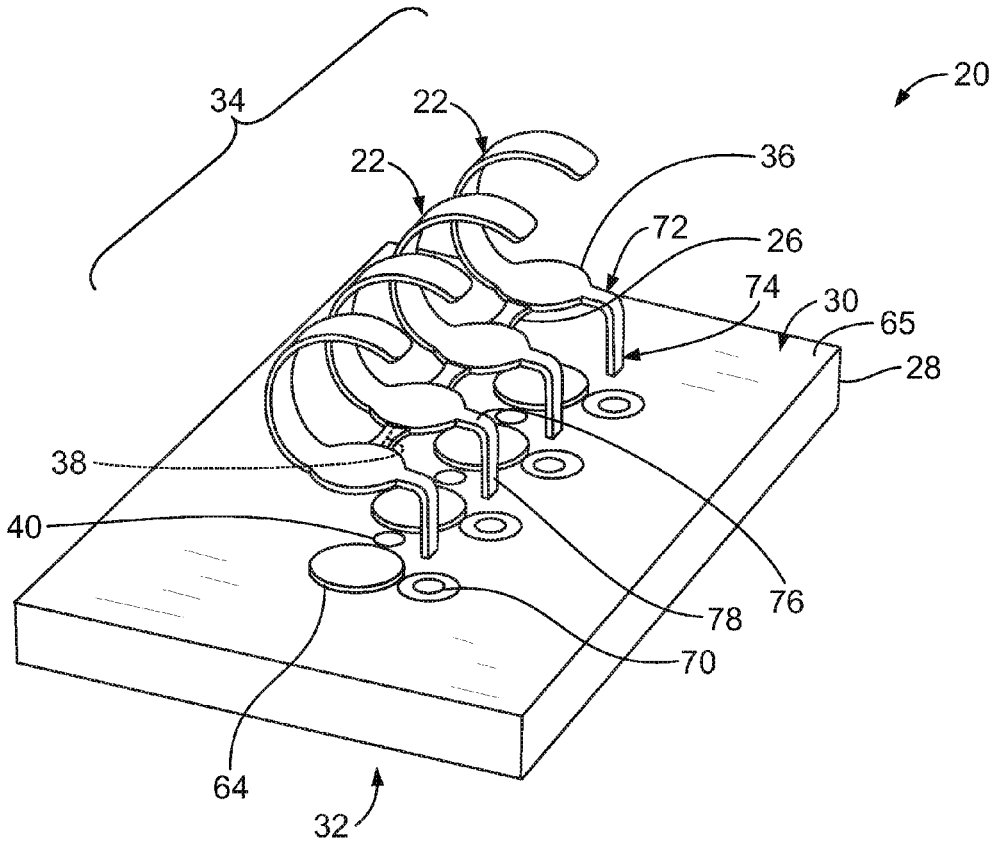
FIG. 2 is an exploded perspective view of a portion of an exemplary embodiment of an interconnect member of the electrical system shown in FIG. 1.

FIG. 2 is an exploded perspective view of a portion of an exemplary embodiment of the interconnect member 20 illustrating the interconnect member 20 before connection strips 26 that interconnect adjacent electrical contacts 22 have been broken. The interconnect member 20 includes a insulator 28 that holds the electrical contacts 22. The insulator 28 includes a module side 30 and an opposite component side 32. FIG. 2 illustrates a portion of a row 34 of the electrical contacts 22. The electrical contacts 22 are mounted on the module side 30 of the insulator 28 for engagement with the contact pads (not shown) on the mating side 24 (FIG. 1) of the electronic module 16 (FIG. 1). The electrical contacts 22 are fabricated from the same sheet or reel of material (not shown). The electrical contacts 22 may be fabricated from the sheet or reel using any process, such as, but not limited to, stamping, cutting, machining, etching, forming, casting, molding and/or the like. Each of the electrical contacts 22 may be referred to herein as a "first" and/or a "second" electrical contact.

The electrical contacts 22 include mounting bases 36. After being fabricated from the sheet or reel, adjacent electrical contacts 22 within the row 34 are mechanically and electrically connected together via the connection strips 26. Each connection strip 26 extends along a connection path 38 that extends from the mounting base 36 of one of the corresponding electrical contacts 22 to the mounting base 36 of the other corresponding electrical contact 22. As will be described below, the connection strips 26 are configured to be broken along the connection paths 38 to mechanically and electrically separate the electrical contacts 22 from each other. Punch openings 40 are provided within the module side 30 of the insulator 28 to enable the connection strips 26 to be broken using a punch 42 (FIG. 5) after the electrical contacts 22 are mechanically connected to the insulator 28. In the exemplary embodiment, the connection path 38 between each pair of adjacent electrical contacts 22 is linear. However, one or more of the connection paths 38 may alternatively include one or more bends, curves, angles, and/or the like such that the connection path 38 is non-linear. The connection path 38 of each connection strip 26 may include any other shape.

Figure 11:
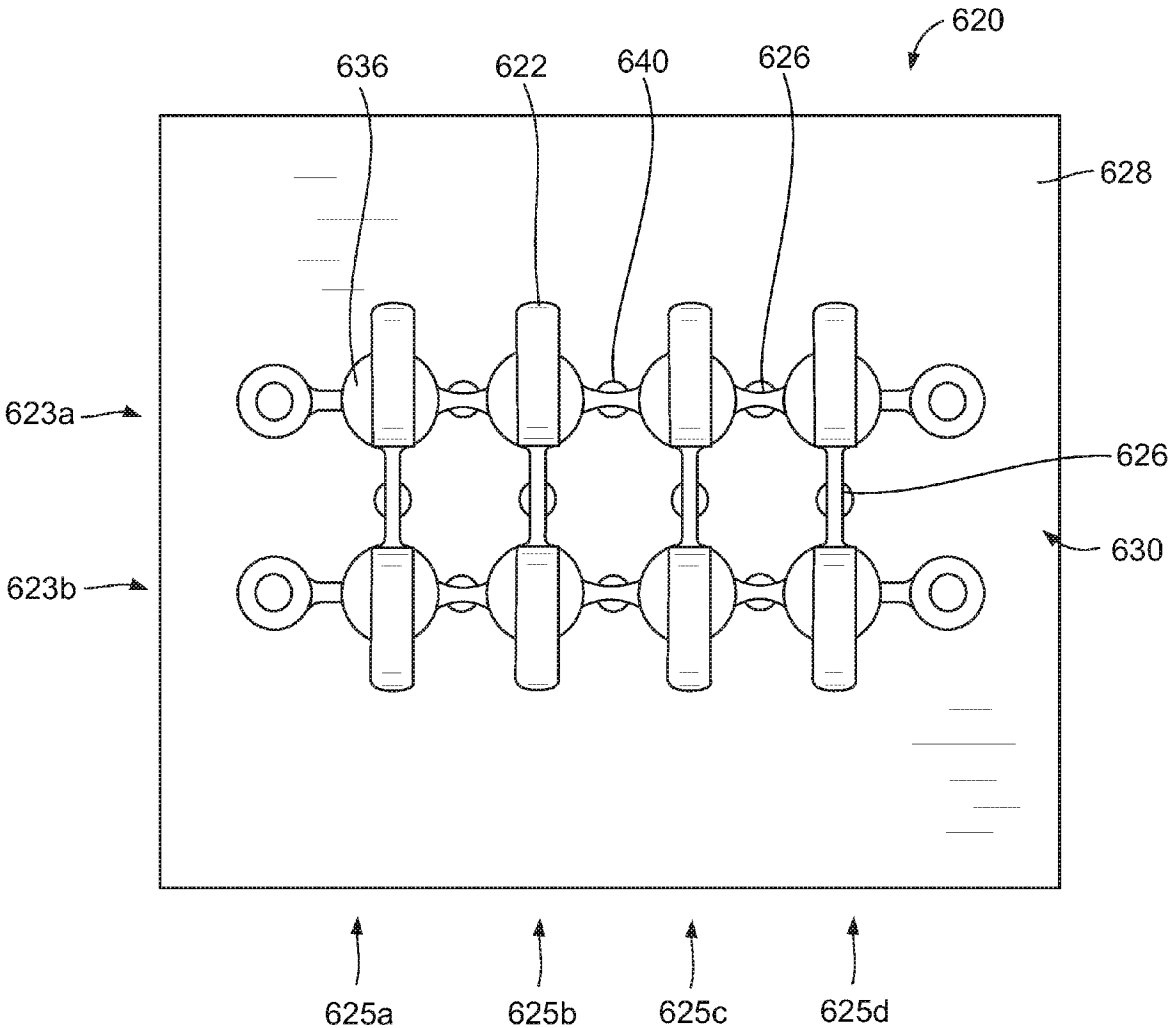
FIG. 11 is a top plan view of a portion of another exemplary alternative embodiment of an interconnect member.

Although FIG. 2 illustrates a portion of the row 34 of the electrical contacts 22, it should be understood that only a portion of the array of electrical contacts 22 is shown in FIG. 2. In other words, only some of the electrical contacts 22 of the interconnect member 20 are shown in FIG. 2. The row 34 may include other electrical contacts 22 that are not shown and the array of electrical contacts 22 may include other rows and/or columns. For example, FIG. 11 is a top plan view of a portion of an exemplary alternative embodiment of an interconnect member 620. The interconnect member 620 includes an insulator 628 having a module side 630, and an array of electrical contacts 622 having mounting bases 636 that are mechanically connected to the insulator 628 on the module side 630. The portion of the array of electrical contacts 622 shown in FIG. 11 includes electrical contacts 622 that are arranged in two rows 623*a* and 623*b* and four columns 625*a*, 625*b*, 625*c*, and 625*d*. The mounting bases 636 of adjacent electrical contacts 622 within each row 623*a* and 623*b* are initially connected together via corresponding connection strips 626. Similarly, the mounting bases 636 of adjacent electrical contacts 622 within each column 625*a-d* are initially connected together via corresponding connection strips 626. Punch openings 640 are formed in the module side 630 of the insulator 628 and aligned with the connection strips 626. Each of the electrical contacts 622 may be referred to herein as a "first" and/or a "second" electrical contact.

In an alternative embodiment, one or more of the electrical contacts 622 within the row 623*a* is not initially connected to one or more adjacent electrical contacts 622 within the row 623*a* via a connection strip 626, and/or one or more of the electrical contacts 622 within the row 623*b* is not initially connected to one or more adjacent electrical contacts 622 within the row 623*b* via a connection strip 626. Similarly, in an alternative embodiment, one or more of the electrical contacts 622 within the column 625*a*, 625*b*, 625*c*, and/or 625*d* is not initially connected to one or more adjacent electrical contacts 622 within the same column 625*a*, 625*b*, 625*c*, and/or 625*d* via a connection strip 626.

Referring again to FIG. 2, the array of electrical contacts 22 may have any number of electrical contacts 22 overall and the contacts 22 may be arranged in any pattern having any number of rows and columns. Although all of the electrical contacts 22 shown in FIG. 2 (as well as, for example, the electrical contacts 622 shown in FIG. 11) are initially connected to adjacent electrical contacts 22 via the connection strips 26, it should be understood that the array of electrical contacts 22 may or may not include individual groups (e.g., rows, columns, other shaped patterns, and/or the like) of interconnected electrical contacts 22 that are not initially connected to the electrical contacts 22 of one or more other groups via connection strips. For example, in an alternative embodiment to the interconnect member 620 shown in FIG. 11, none of the electrical contacts 622 within the row 623*a* are initially connected to adjacent electrical contacts 622 within the row 623*b* via a connection strip. Each electrical contact 22 may be initially connected to only some or to all electrical contacts 22 that are adjacent thereto.

Figure 3:
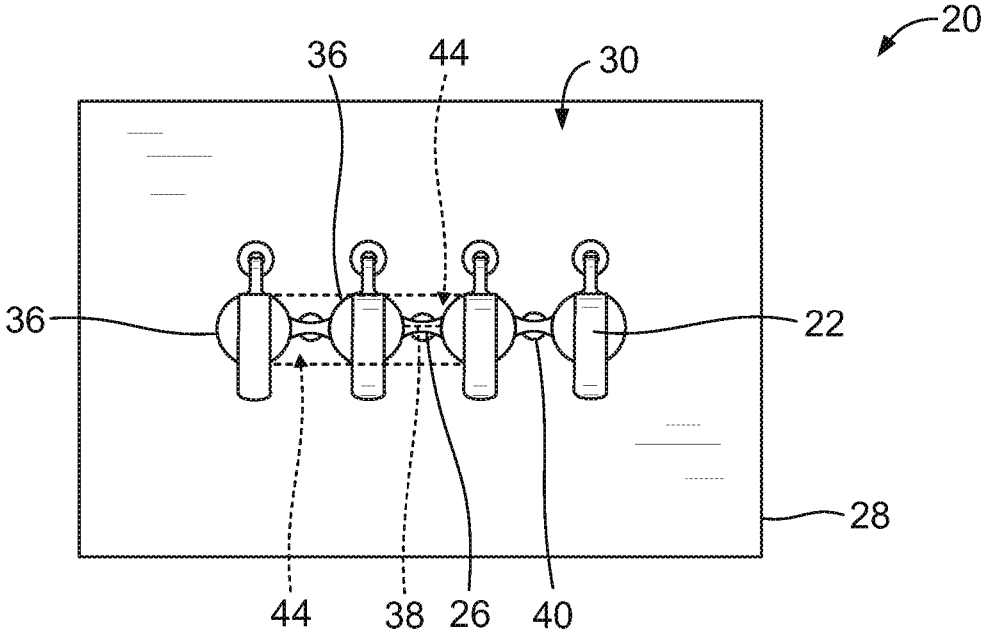
FIG. 3 is a top plan view of the portion of the interconnect member shown in FIG. 2.

FIG. 3 is a top plan view of the portion of the interconnect member 20 shown in FIG. 2 illustrating an exemplary embodiment of the module side 30 of the insulator 28. The electrical contacts 22 are shown in FIG. 3 mechanically connected to the insulator 28 on the module side 30. Each punch opening 40 is positioned along the module side 30 of the insulator 28 in alignment with the connection path 38 of the corresponding connection strip 26. In other words, the punch openings 40 are aligned with the corresponding connection strips 26. In the exemplary embodiment, the punch openings 40 are positioned along the module side 30 of the insulator 28 between the mounting bases 36 of the corresponding adjacent electrical contacts 22. Optionally, a straight line drawn from the center of one mounting base 36 to the center of an adjacent mounting base 36 intersects the corresponding punch opening 40.

The exemplary position of the punch openings 40 between the mounting bases 36 is a result of the exemplary connection paths 38 that extend entirely between the corresponding mounting bases 36. As used herein, "between" the mounting bases 36 is intended to mean an area 44 that is bounded by the dashed lines in FIG. 3, which extend from the peripheries of one of the mounting bases 36 to the peripheries of the adjacent mounting base 36. In embodiments wherein a connection strip 26 extends along a connection path 38 that extends at least partially outside the area 44, the corresponding punch opening 40 may be positioned outside of the area 44, so long as the corresponding punch opening 40 is aligned with the connection path 38 somewhere therealong.

Figure 4:
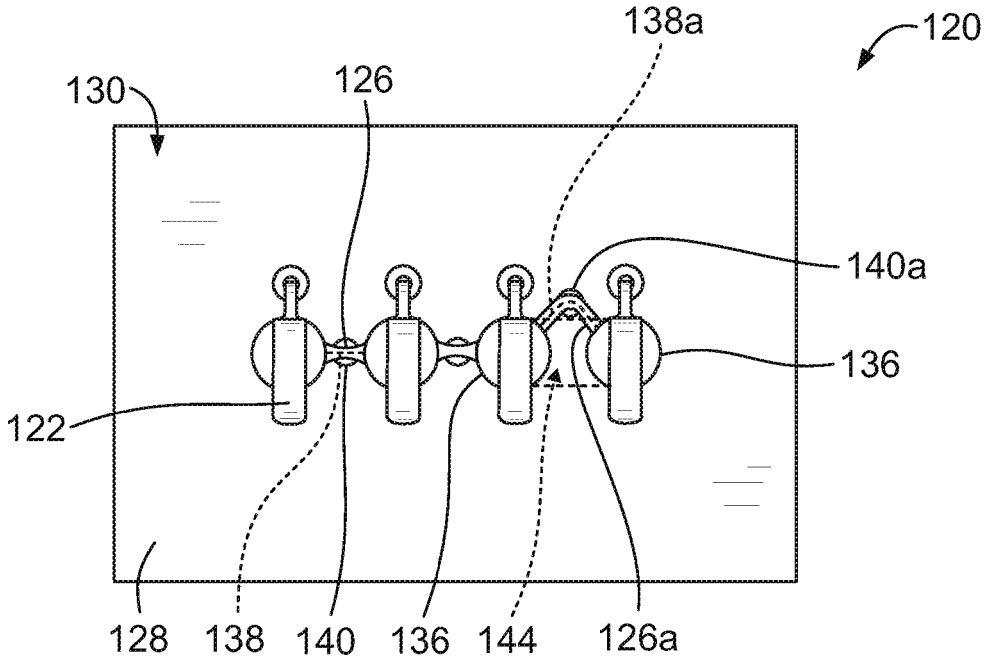
FIG. 4 is a top plan view of a portion of an exemplary alternative embodiment of an interconnect member.

For example, FIG. 4 illustrates a portion of an alternative embodiment of an interconnect member 120 wherein the connection path 138*a* of one of the connection strips 126*a* extends outside of an area 144 between the corresponding adjacent mounting bases 136. The interconnect member 120 includes a insulator 128 having a module side 130, and electrical contacts 122 having mounting bases 136 mechanically connected to the insulator 128 on the module side 130. The mounting bases 136 of adjacent electrical contacts 122 are connected together via corresponding connection strips 126 that extend along connection paths 138. Punch openings 140 are formed in the module side 130 and aligned with the connection strips 126. The connection path 138*a* of one of the connection strips 126*a* extends outside of an area 144 between the corresponding adjacent mounting bases 136. The corresponding punch opening 140*a* is positioned along the module side 130 of the insulator 128 outside of the area 144 between the corresponding mounting bases 136. The punch opening 140*a* is aligned with the connection path 138*a* outside of the area 144.

Figure 5:
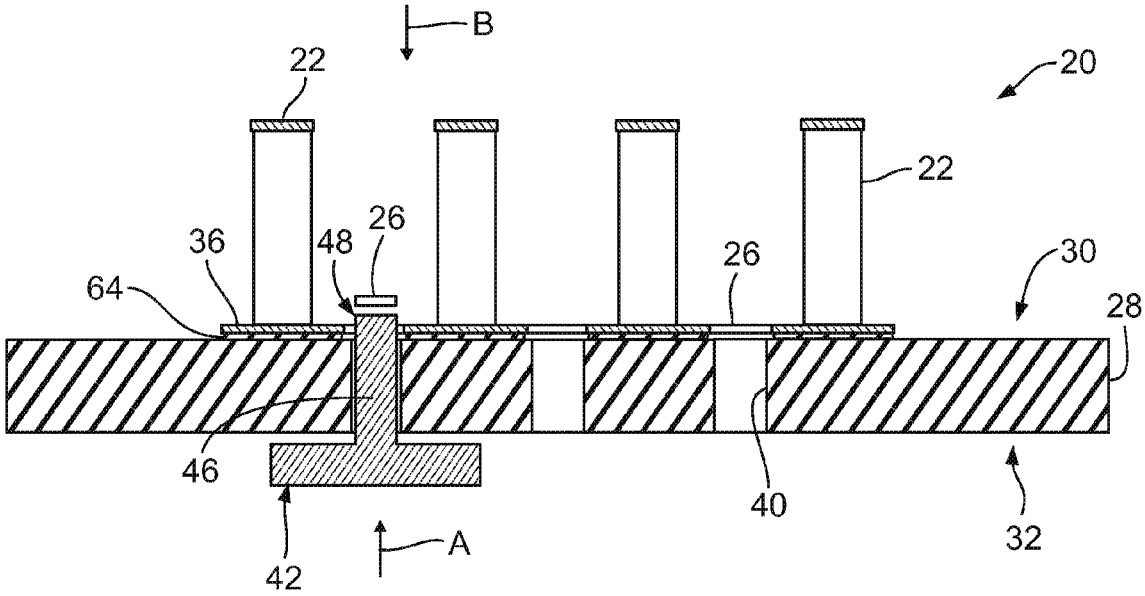
FIG. 5 is a cross-sectional view of the portion of the interconnect member shown in FIGS. 2 and 3.

FIG. 5 is a cross-sectional view of the portion of the interconnect member 20 shown in FIGS. 2 and 3. In the exemplary embodiment, the punch openings 40 extend completely through the insulator 28. In other words, each punch opening 40 extends through both of the module and component sides 30 and 32, respectively, and completely through the insulator 28 between the sides 30 and 32. As can be seen in FIG. 5, the connection strips 26 extending along the module side 30 of the insulator 28 are exposed to the component side 32 through the punch openings 40. Exposure of the connection strips 26 along the component side 32 of the insulator 28 enables the connection strips 26 to be broken from the component side 32. In an alternative embodiment, one or more of the punch openings 40 does not extend completely through the insulator 28. For example, one or more of the punch openings 40 may alternatively extend through the module side 30 and through only a portion of the insulator 28 between the sides 30 and 32, such that the punch opening 40 does not extend through the component side 32. As will be described below, the connection strips 26 may be broken using the punch 42 (FIG. 5) from either the component side 32 or the module side 30.

The electrical contacts 22 are illustrated in FIG. 5 as mounted on the insulator 28. More particularly, the mounting bases 36 of the electrical contacts 22 are mechanically connected to the insulator 28 on the module side 30. The mounting of the electrical contacts 22 on the insulator 28 will be described below. As shown in FIG. 5 and described above with reference to FIG. 2, the mounting bases 36 of the electrical contacts 22 are initially mechanically and electrically connected together by the connection strips 26. After the electrical contacts 22 have been mechanically connected to the insulator 28, the electrical contacts 22 can be separated from each other by breaking the connection strips 26.

In the exemplary embodiment, the punch 42 is used to break the connection strips 26. The punch 42 includes a punch tool 46 having an end 48 that is configured to engage a connection strip 26. The end 48 of the punch tool 46 is configured to sever, or break, the connection strip 26 when sufficient force is applied to the punch 42. Although shown as including an approximately planar surface, the end 48 of the punch tool 46 may additionally or alternatively include any other shape (e.g., a point, a round, a tip, a cutting edge, and/or the like) that enables the punch tool 46 to break the connection strip 26. In the exemplary embodiment, the approximately planar surface of the end 48 of the punch tool 46 enables the punch tool 46 to break the connection strip 26. Optionally, the punch 42 includes more than one punch tool 46 for simultaneously breaking more than one connection strip 26. The punch 42 may include any number of the punch tools 46 for simultaneously breaking any number of connection strips 26.

Figure 6:
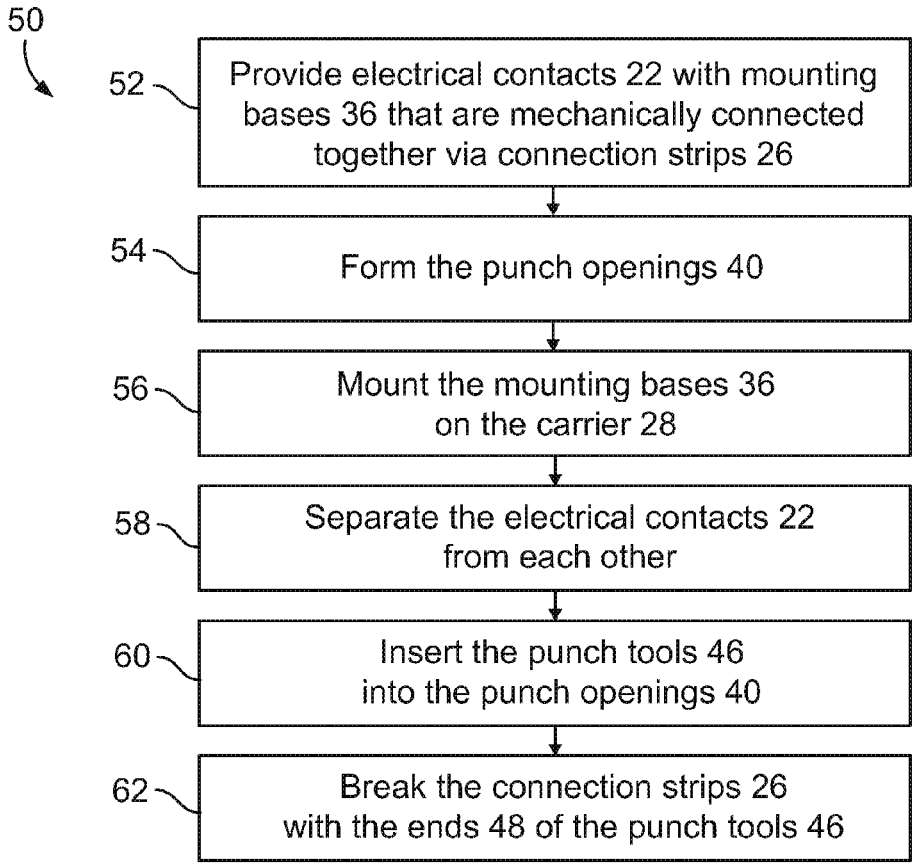
FIG. 6 is a flow chart illustrating an exemplary embodiment of a method for fabricating the interconnect member shown in FIGS. 2, 3, and 5.

FIG. 6 is a flow chart illustrating an exemplary embodiment of a method 50 for fabricating the electrical connector 12. More particularly, the method 50 is used to fabricate the interconnect member 20. Unless otherwise indicated, the steps of the method 50 may be performed in any order, including steps labeled with a reference numeral and steps that are not labeled with a reference numeral. Referring now to FIGS. 5 and 6, the method 50 includes providing 52 the electrical contacts 22 with the mounting bases 36 that are mechanically connected together via the connection strips 26. The method 50 also includes forming 54 the punch openings 40. The mounting bases 36 of the electrical contacts 22 are mounted 56 on the insulator 28. More particularly, the mounting bases 36 are mechanically connected to the insulator 28. Optionally, mounting 56 the mounting bases 36 on the insulator 28 includes soldering the mounting bases 36 to corresponding solder pads 64 of the insulator 28.

After the mounting bases 36 of the electrical contacts 22 have been mounted 56 on the insulator 28, the electrical contacts 22 are separated 58 from each other by breaking the connection strips 26. In the exemplary embodiment, the electrical contacts 22 are separated 58 from each other after the mounting bases 36 have been soldered to the solder pads 64 of the insulator 28. Separating 58 the electrical contacts 22 from each other includes inserting 60 the punch tool 46 into the punch openings 40. The end 48 of the punch tool 46 is engaged with the corresponding connection strip 26. Force is applied to the punch 42 in the direction of the arrow A until the connection strip 26 is broken 62 by the end 48 of the punch tool 46, as shown in FIG. 5. In the exemplary embodiment, the punch tool 46 is inserted through the punch opening 40 from the component side 32 of the insulator 28. Separating 58 the electrical contacts 22 from each other thus includes inserting the punch tool 46 through the punch openings 40 from the component side 32 and breaking the connection strips 26 along the module side 30 of the insulator 28. The exemplary embodiment of the punch openings 40 enable the connection strips 26 to be broken from the component side 32 (i.e., using the punch 42 on the component side 32).

The connection strips 26 may alternatively be broken from the module side 30 of the insulator 28. Specifically, the punch 42 is positioned along the module side 30 of the insulator 28 and the end 48 of the punch tool 46 is engaged with the connection strip 26. Force is applied to the punch 42 in the direction of the arrow B until the connection strip 26 is broken 62 by the end 48 of the punch tool 46. After breaking the connection strip 26, the end 48 of the punch tools 46 is received into the corresponding punch opening 40. The punch openings 40 therefore provide accommodation for the end 48 of the punch tool 46, which would otherwise be forced into engagement with the insulator 28 and thereby possibly damage the insulator 28 and/or the punch 42. In another alternative embodiment, one or more of the connection strips 26 is broken using a punch from the component side 32, while one or more other connection strips 26 is broken using another punch (or the same punch at a different time) from the module side 30.

In an alternative embodiment, the connection strips 26 are broken after the electrical contacts 22 are mechanically connected to the insulator 28 using any other process. For example, the connection strips 26 may alternatively be broken by cutting the connection strips 26 with a laser and/or other cutting tool (not shown), by chemically etching the connection strips 26, and/or the like.

Figure 7:
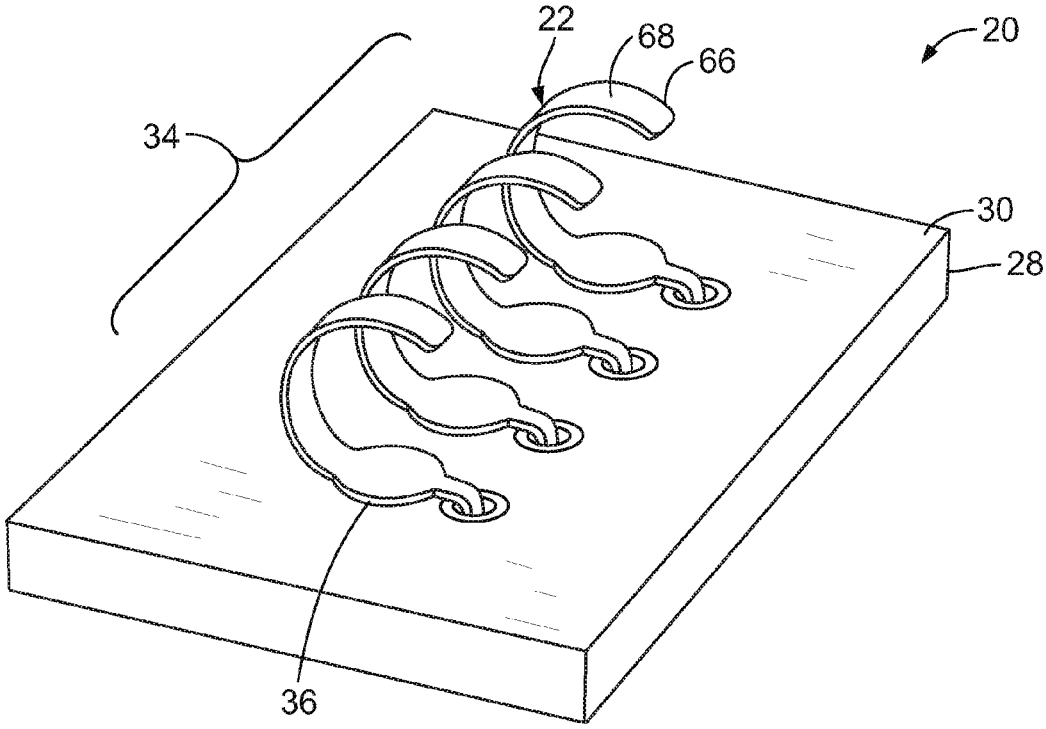
FIG. 7 is a perspective view of the portion of the interconnect member shown in FIGS. 2 and 3 illustrating electrical contacts of the interconnect member after the electrical contacts have been separated from each other.

FIG. 7 is a perspective view of the portion of the interconnect member 20 shown in FIGS. 2 and 3 illustrating the electrical contacts 22 after separation 58 (FIG. 6) of the electrical contacts 22 from each other. The electrical contacts 22 are mounted on the module side 30 of the insulator 28. The connection strips 26 (FIGS. 2, 3, and 5) have been broken and removed such that the mounting bases 36 of the electrical contacts 22 are no longer mechanically and electrically connected together. Accordingly, the electrical contacts 22 within the row 34 are electrically isolated from each other.

Each electrical contact 22 includes a mating segment 66 that extends outwardly from the mounting base 36. The mating segments 66 include mating interfaces 68 that are configured to engage the corresponding contact pads (not shown) on the mating side 24 (FIG. 1) of the electronic module 16 (FIG. 1) to electrically connect the electrical contacts 22 to the electronic module 16. Optionally, the mating segments 66 are resiliently deflectable springs that are configured to deflect toward the insulator 28 when engaged with the contact pads of the electronic module 16. In addition or alternative to being resiliently deflectable springs, an elastomeric column (not shown) is optionally disposed between the mounting base 36 and the mating segment 66 of one or more of the electrical contacts 22. The mating segments 66 are shown herein including a curved shape that curls back over the mounting bases 36. But, the mating segments 66 may additionally or alternatively include any other shape.

Figure 8:
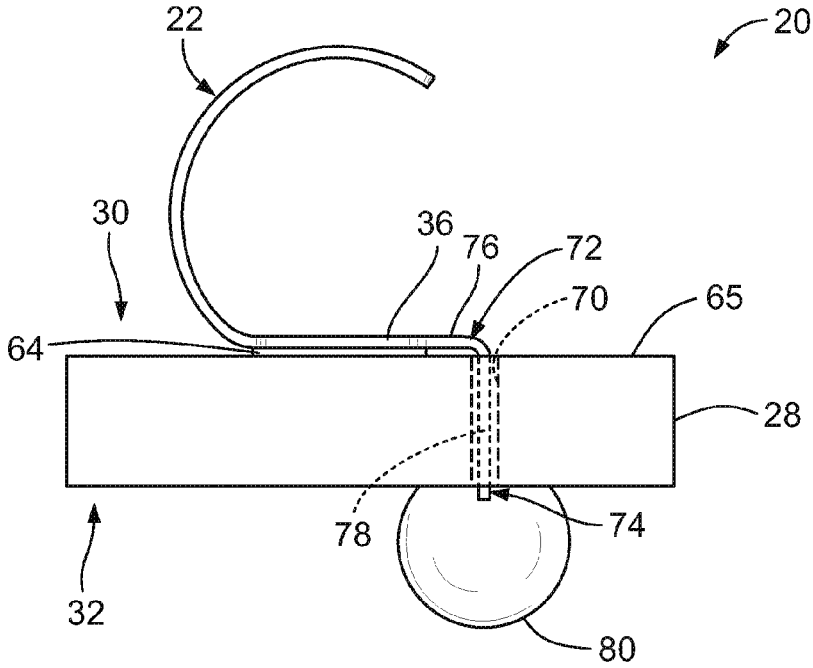
FIG. 8 is a side elevational view of the portion of the interconnect member shown in FIG. 7 illustrating a solderball for directly mounting to a printed circuit.

FIG. 8 is a side-elevational view of the portion of the interconnect member 20 shown in FIG. 7. Referring now to FIGS. 2 and 8, in the exemplary embodiment, the insulator 28 includes the solder pads 64 for mounting the electrical contacts 22 on the insulator 28. The mounting bases 36 of the electrical contacts 22 are soldered to the corresponding solder pads 64 to mechanically connect the mounting bases 36, and thus the electrical contacts 22, to the module side 30 of the insulator 28. In addition or alternatively to being soldered, the mounting bases 36 are mechanically connected to the solder pads 64 and/or other structures on the module side 30 of the insulator 28 using an adhesive, using a press-fit connection, using a snap-fit connection, and/or using another type of mechanical fastener, connection, and/or the like. Moreover, in alternative to the solder pads 64, the mounting bases 36 may be mechanically connected directly to a surface 65 of the insulator 28 that defines the module side 30.

Alignment holes 70 extend into the module side 30 of the insulator 28. The alignment holes 70 are positioned proximate corresponding ones of the solder pads 64. The electrical contacts 22 include alignment tails 72 that extend outwardly from the mounting bases 36. Each alignment tail 72 is received within the corresponding alignment hole 70. Reception of the alignment tails 72 within the alignment holes 70 positions (i.e., locates and orients) the mounting bases 36 relative to the solder pads 64. In other words, the alignment holes 70 and the alignment tails 72 cooperate to provide the electrical contacts 22 with the proper location and orientation on the module side 30 of the insulator 28.

The alignment tails 72 extend outwardly from the mounting bases 36 to tips 74. Each alignment tail 70 includes a module side segment 76 that extends outwardly from the mounting base 36 and a hole segment 78 that extends from the module side segment 76 and includes the tip 74. The module side segment 76 extends along the module side 30 of the insulator 28. The hole segment 78 extends outwardly from the module side segment 76 and into the corresponding alignment hole 70. The tip 74 of each alignment tail 72 is engaged with a corresponding solder ball 80 (not visible in FIG. 2) on the component side 32 of the insulator 28. The alignment tails 72 electrically connect the electrical contacts 22 on the module side 30 of the insulator 28 to the solder balls 80 on the component side 32 of the insulator 28. The solder balls 80 are configured to engage the corresponding contact pads (not shown) on the printed circuit 14 (FIG. 1) to electrically connect the electrical contacts 22 to the printed circuit 14.

Optionally, the alignment tails 72 are engaged with the insulator 28 within the alignment holes 70. For example, the hole segments 78 of the alignment tails 72 may be received within the alignment holes 70 with an interference fit. Additionally or alternatively, the hole segments 78 may include barbs (not shown) that engage the insulator 28 within the alignment holes 70. The alignment holes 70 are optionally tapered inwardly as they extend into the insulator 28 toward the component side 32 to facilitate engagement between the alignment tails 72 and the insulator 28 within the alignment holes 70.

In an alternative embodiment, the tips 74 of the alignment tails 72 do not engage the solder balls 80. Rather, the alignment holes 70 are electrically conductive vias. The alignment tails 72 and the solder balls 80 are engaged with the conductive materials of the alignment holes 70 such that the conductive materials of the alignment holes 70 electrically connect the alignment tails 72 to the solder balls 80. In yet another alternative embodiment, electrically conductive vias (not shown) extend through the insulator 28 from the solder pads 64 to the component side 32 of the insulator 28. The solder balls 80 are engaged with the conductive vias. The conductive vias electrically connect the solder pads 64, and thus the mounting bases 36, on the module side 30 of the insulator 28 to the solder balls 80 on the component side 32. It should be appreciated that in alternative embodiments wherein the alignment holes 70 are not used to electrically connect the electrical contacts 22 to the solder balls 80, the alignment holes 70 may not extend completely through the insulator 28.

Figure 9:
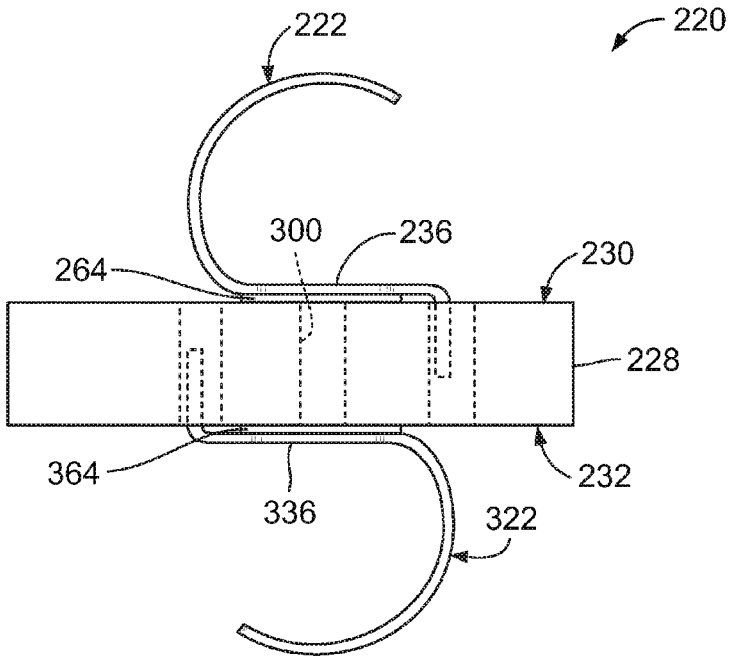
FIG. 9 is a side elevational view of a portion of an exemplary alternative embodiment of an interconnect member illustrating electrical contacts mounted on both sides of an insulator.

FIG. 9 is a side elevational view of a portion of an exemplary alternative embodiment of an interconnect member 220. Rather than using the solder balls 80 (FIG. 8), the interconnect member 220 includes electrical contacts 322 on a component side 232 of the interconnect member 220. The interconnect member 220 includes a insulator 228 having a module side 230 and the component side 232. Electrical contacts 222 are mounted on the module side 230 for engagement with the contact pads (not shown) on the mating side 24 (FIG. 1) of the electronic module 16 (FIG. 1). The electrical contacts 322 are mounted on the component side 232 of the insulator 228 for engagement with the contact pads (not shown) of the printed circuit 14 (FIG. 1). Each of the electrical contacts 222 may be referred to herein as a "first" and/or a "second" electrical contact. Each of the electrical contacts 322 may be referred to herein as a "third" electrical contact.

The electrical contacts 222 and 322 include respective mounting bases 236 and 336. The mounting bases 236 and 336 are mechanically and electrically connected to respective solder pads 264 and 364 on the module and component sides 230 and 232, respectively, of the insulator 228. Electrically conductive vias 300 extend through the insulator 228 from the solder pads 264 to the solder pads 364. The vias 300 electrically connect each solder pad 264 on the module side 230 of the insulator 228 to a corresponding solder pad 364 on the component side 232 of the insulator 228. Accordingly, each conductive via 300 electrically connects a corresponding electrical contact 222 on the module side 230 with a corresponding electrical contact 322 on the component side 232 of the insulator 228.

Similar to the electrical contacts 22 (FIGS. 1-3, 5, 7 and 8), adjacent electrical contacts 222 are initially mechanically and electrically connected together via connection strips (not shown). Adjacent electrical contacts 322 are also initially mechanically and electrically connected together via connection strips (not shown). It should be appreciated that a single punch opening (not shown) may be aligned with both a connection strip that interconnects two adjacent electrical contacts 222 and another connection strip that interconnects the corresponding adjacent electrical contacts 322. In other words, a single punch opening may be used to break both a connection strip extending along the module side 230 of the insulator 228 and another connection strip extending along the component side 232 of the insulator 228. The end 48 (FIG. 5) of the punch tool 46 (FIG. 5) may first be used to break the connection strip on the module side 230 of the insulator 228 and thereafter inserted through the punch opening to break the connection strip on the component side 232 of the insulator 228, or vice versa.

Figure 10:
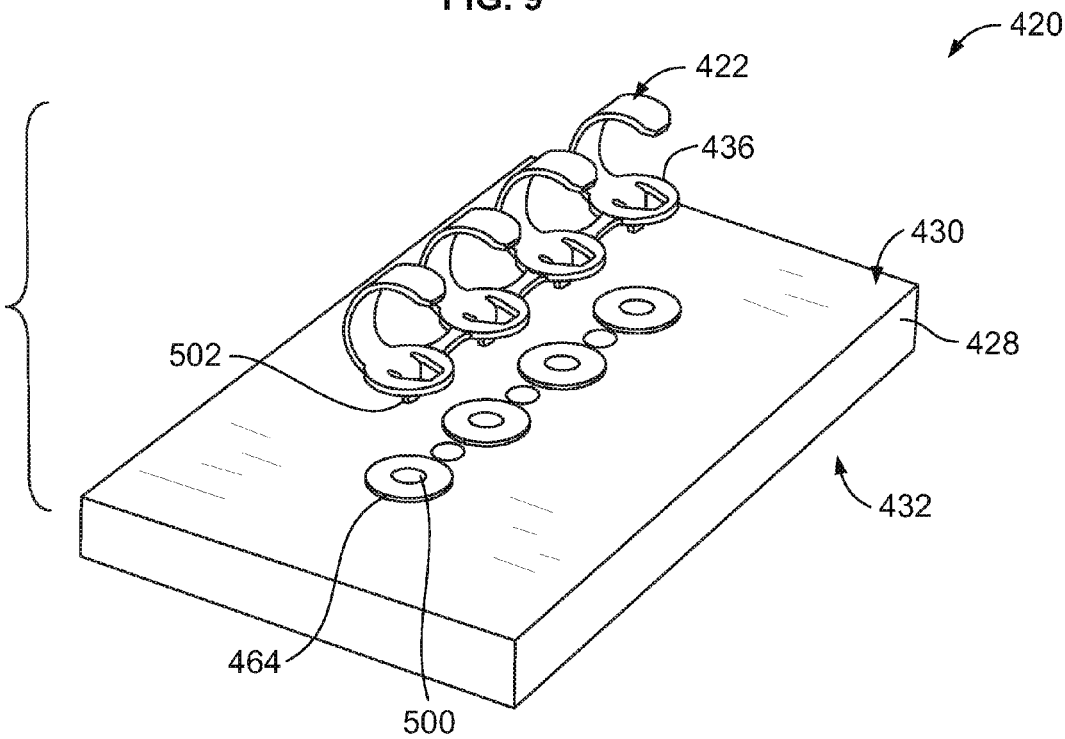
FIG. 10 is an exploded perspective view of a portion of another exemplary alternative embodiment of an interconnect member.

FIG. 10 is an exploded perspective view of a portion of another exemplary alternative embodiment of an interconnect member 420. The interconnect member 420 includes a insulator 428 having a module side 430 and a component side 432. Electrical contacts 422 are mounted on the module side 430 for engagement with the contact pads (not shown) on the mating side 24 (FIG. 1) of the electronic module 16 (FIG. 1). The electrical contacts 422 include mounting bases 436 that are mechanically connected to solder pads 464 on the module side 430 of the insulator 428. Electrically conductive vias 500 extend through the solder pads 464 and the insulator 428. Each of the electrical contacts 422 may be referred to herein as a "first" and/or a "second" electrical contact.

In addition or alternative to being mechanically connected to the solder pads 464 using solder and/or adhesive, the mounting bases 464 include retention barbs 502 that extend into the conductive vias 500. The retention barbs 502 engage the conductive vias 500 with an interference fit to mechanically connect the electrical contacts 422 to the insulator 428. Electrical connection of the electrical contacts 422 to the conductive vias 500 may be provided by engagement of the mounting bases 436 with the solder pads 464, a solder and/or adhesive connection between the mounting bases 436 and the solder pads 464, and/or engagement of the retention barbs 502 with the conductive vias 500. Reception of the retention barbs 502 within the conductive vias 500 positions the mounting bases 436 relative to the solder pads 464.

The embodiments described and/or illustrated herein may provide an electrical connector that is easier to assemble, less expensive to assemble, and/or takes less time to assemble than at least some known electrical connectors.

As used herein, the term "printed circuit" is intended to mean any electric circuit in which the conducting connections have been printed or otherwise deposited in predetermined patterns on an electrically insulating substrate. A substrate of the printed circuit 14 may be a flexible substrate or a rigid substrate. The substrate may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate is a rigid substrate fabricated from epoxy-glass, such that the printed circuit 14 is what is sometimes referred to as a "circuit board" or a "printed circuit board".

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for electrically connecting an electronic module to an electrical component, said electrical connector comprising:

electrical contacts having mounting bases that are initially mechanically connected together by a connection strip, the connection strip extending along a connection path from the mounting base of one of electrical contacts to the mounting base of the other electrical contact, the connection strip being broken along the connection path such that the electrical contacts are separated from each other; and a insulator having a module side and an opposite component side, the mounting bases of the electrical contacts being mechanically connected to the insulator on an exterior surface of the module side of the insulator, the insulator comprising a punch opening extending into the module side of the insulator, the punch opening being aligned with the connection path of the connection strip and being configured to receive a punch tool for breaking the connection strip.

2. The electrical connector according to claim 1, wherein the punch opening is positioned along the module side of the insulator between the mounting bases of the electrical contacts.

3. The electrical connector according to claim 1, wherein the punch opening is positioned on the module side of the insulator such that an approximately straight line drawn from the mounting base of the one of the electrical contacts to the mounting base of the other electrical contact intersects the punch opening.

4. The electrical connector according to claim 1, wherein the punch opening is positioned on the module side of the insulator such that an approximately straight line drawn from a center of the mounting base of the one of the electrical contacts to a center of the mounting base of the other electrical contact intersects the punch opening.

5. The electrical connector according to claim 1, further comprising solder balls mounted on the component side of the insulator, wherein the solder balls are electrically connected to corresponding ones of the electrical contacts.

6. The electrical connector according to claim 1, further comprising solder balls mounted on the component side of the insulator and alignment holes extending through the insulator, the electrical contacts comprising alignments tails that extend from the mounting bases, the alignment tails being received within corresponding ones of the alignment holes and being engaged with corresponding ones of the solder balls to electrically connect the electrical contacts to the corresponding solder balls.

7. The electrical connector according to claim 1, wherein the electrical contacts are first and second electrical contacts, the electrical connector further comprising a third electrical contact mechanically connected to the insulator on the component side of the insulator, the third electrical contact being electrically connected to the first electrical contact.

8. The electrical connector according to claim 1, wherein the electrical contacts are first and second electrical contacts, the electrical connector further comprising a third electrical contact mechanically connected to the insulator on the component side of the insulator, the insulator comprising an electrically conductive via extending therethrough, the first and third electrical contacts being electrically connected together through the via.

9. The electrical connector according to claim 1, wherein the punch opening extends through the component side of the insulator and completely through the insulator between the module and component sides.

10. The electrical connector according to claim 1, wherein the mounting bases of the electrical contacts are mechanically connected to the insulator on the module side of the insulator using at least one of solder, an adhesive, a press-fit connection, or a snap-fit connection.

11. An electrical connector for electrically connecting an electronic module to an electrical component, said electrical connector comprising:

electrical contacts having mounting bases that are initially mechanically connected together by a connection strip, the connection strip extending along a connection path from the mounting base of one of electrical contacts to the mounting base of the other electrical contact, the connection strip being broken along the connection path such that the electrical contacts are separated from each other; and a insulator having a module side and an opposite component side, the mounting bases of the electrical contacts being mechanically connected to the insulator, the insulator comprising a punch opening extending into the module side of the insulator, the punch opening being aligned with the connection path of the connection strip and being configured to receive a punch tool for breaking the connection strip, wherein the insulator comprises alignment holes extending into the module side of the insulator, the electrical contacts comprising alignment tails that extend from the mounting bases, the alignment tails being received within corresponding ones of the alignment holes for positioning the mounting bases of the electrical contacts on the module side of the insulator.

12. An electrical connector for electrically connecting an electronic module to an electrical component, said electrical connector comprising:

electrical contacts having mounting bases that are initially mechanically connected together by a connection strip, the connection strip extending along a connection path from the mounting base of one of electrical contacts to the mounting base of the other electrical contact, the connection strip being broken along the connection path such that the electrical contacts are separated from each other; and a insulator having a module side and an opposite component side, the mounting bases of the electrical contacts being mechanically connected to the insulator on the module side of the insulator, the insulator comprising a punch opening extending into the module side of the insulator, the punch opening being aligned with the connection path of the connection strip and being configured to receive a punch tool for breaking the connection strip, wherein the insulator comprises solder pads extending along the module side, the mounting bases of the electrical contacts being soldered to corresponding ones of the solder pads.

13. An electrical connector for electrically connecting an electronic module to an electrical component, said electrical connector comprising:

electrical contacts having mounting bases that are mechanically connected together by a connection strip, the connection strip extending along a connection path from the mounting base of one of the electrical contacts to the mounting base of the other electrical contact; and a insulator having a module side and an opposite component side, the mounting bases of the electrical contacts being mechanically connected to the insulator on the module side of the insulator and not being embedded within the insulator, the insulator comprising a punch opening extending into the module side of the insulator, the punch opening being configured to receive a punch tool, the punch opening being aligned with the connection strip such that when the punch tool is received within the punch opening the punch tool is positioned to break the connection strip.

14. The electrical connector according to claim 13, wherein the punch opening is positioned along the module side of the insulator between the mounting bases of the electrical contacts.

15. The electrical connector according to claim 13, wherein the punch opening is positioned on the module side of the insulator such that an approximately straight line drawn from the mounting base of one of the electrical contacts to the mounting base of the other electrical contact intersects the punch opening.

16. The electrical connector according to claim 13, wherein the punch opening is positioned on the module side of the insulator such that an approximately straight line drawn from a center of the mounting base of one of the electrical contacts to a center of the mounting base of the other electrical contact intersects the punch opening.

17. The electrical connector according to claim 13, wherein the mounting bases of the electrical contacts are mechanically connected to the insulator on the module side of the insulator using at least one of solder, an adhesive, a press-fit connection, or a snap-fit connection.

18. The electrical connector according to claim 13, wherein the insulator comprises solder pads extending along the module side, the mounting bases of the electrical contacts being soldered to corresponding ones of the solder pads.

19. The electrical connector according to claim 13, wherein the insulator comprises alignment holes extending into the module side of the insulator, the electrical contacts comprising alignment tails that extend from the mounting bases, the alignment tails being received within corresponding ones of the alignment holes for positioning the mounting bases of the electrical contacts on the module side of the insulator.

20. A method for fabricating an electrical connector, said method comprising:

providing electrical contacts having mounting bases that are mechanically connected together via a connection strip;

soldering the mounting bases of the electrical contacts to corresponding solder pads of a insulator; and separating the electrical contacts from each other by breaking the connection strip after soldering the mounting bases of the electrical contacts to the solder pads of the insulator.

21. The method according to claim 20, wherein separating the electrical contacts from each other comprises breaking the connection strip with a punch tool.

22. The method according to claim 20, wherein separating the electrical contacts from each other comprises:

forming a punch opening within the insulator, the punch opening being aligned with the connection strip;

inserting a punch tool into the punch opening within the insulator; and breaking the connection strip with an end of the punch tool.

23. The method according to claim 20, wherein the insulator comprises a module side having the solder pads and a component side that is opposite the module side, and wherein:

the method further comprises forming a punch opening that extends through the insulator, the punch opening being aligned with the connection strip;

soldering the mounting bases comprises soldering the mounting bases of the electrical contacts to the solder pads on the module side of the insulator; and separating the electrical contacts from each other comprises inserting a punch tool through the punch opening from the component side of the insulator and breaking the connection strip with an end of the punch tool along the module side of the insulator.

24. The method according to claim 20, wherein the electrical contacts are a first pair of electrical contacts, the connection strip is a first connection strip, and the insulator comprises a module side on which the first pair of electrical contacts are soldered and a component side that is opposite the module side, the method further comprising:

providing a second pair of electrical contacts that are mechanically connected together via a second connection strip;

forming a punch opening that extends through the insulator and is aligned with the first and second connection strips;

soldering the electrical contacts of the second pair of electrical contacts to corresponding solder pads on the component side of the insulator;

breaking the first connection strip or the second connection strip with an end of a punch tool after soldering the mounting bases of the first and second pairs of electrical contacts to the solder pads of the insulator;

inserting the punch tool through the punch opening; and breaking the other of the first or the second connection strip with the end of the punch tool.

* * * * *